US010412478B2

(12) United States Patent
Hviid

(10) Patent No.: US 10,412,478 B2
(45) **Date of Patent: *Sep. 10, 2019**

(54) REPRODUCTION OF AMBIENT ENVIRONMENTAL SOUND FOR ACOUSTIC TRANSPARENCY OF EAR CANAL DEVICE SYSTEM AND METHOD

(71) Applicant: BRAGI GmbH, München (DE)

(72) Inventor: Nikolaj Hviid, München (DE)

(73) Assignee: BRAGI GmbH, München (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/940,607

(22) Filed: Mar. 29, 2018

(65) Prior Publication Data

US 2018/0234754 A1 Aug. 16, 2018

Related U.S. Application Data

(63) Continuation of application No. 15/244,958, filed on Aug. 23, 2016, now Pat. No. 9,949,008.
(Continued)

(51) Int. Cl.
*H04R 25/00* (2006.01)
*H04R 1/10* (2006.01)

(52) U.S. Cl.
CPC ..... *H04R 1/1016* (2013.01); *H04R 1/1075* (2013.01); *H04R 1/1091* (2013.01); *H04R 2420/07* (2013.01); *H04R 2460/05* (2013.01)

(58) Field of Classification Search
CPC .. H04R 1/1016; H04R 1/1075; H04R 1/1091; H04R 2460/05
See application file for complete search history.

(56) References Cited

U.S. PATENT DOCUMENTS 2,325,590 A 8/1943 Carlisle et al.
2,430,229 A 11/1947 Kelsey
(Continued)

FOREIGN PATENT DOCUMENTS

CN 204244472 U 4/2015
CN 104683519 A 6/2015
(Continued)

OTHER PUBLICATIONS

Stretchgoal—The Carrying Case for the Dash (Feb. 12, 2014).
(Continued)

*Primary Examiner* — Amir H Etesam
(74) *Attorney, Agent, or Firm* — Goodhue, Coleman & Owens, P.C.

(57) ABSTRACT

An ear piece for use by an individual having an external auditory canal includes an earpiece housing configured for placement within the external auditory canal of the individual, a processor disposed within the ear piece housing, at least one microphone disposed within the earpiece housing wherein the at least one earpiece is positioned to detect ambient environmental sound, and at least one speaker disposed within the earpiece housing. The ear piece is configured to detect ambient environmental sound proximate the external auditory canal of the individual using the at least one microphone and reproduce the ambient environmental sound at the at least one speaker within the earpiece housing. The processor is further configured to modify the ambient environmental sound based on shape of the external auditory canal such that audio perception of the ambient environmental sound is as if the ear piece was not present.

20 Claims, 4 Drawing Sheets

Related U.S. Application Data

(60) Provisional application No. 62/211,732, filed on Aug. 29, 2015.

(56) References Cited

U.S. PATENT DOCUMENTS

| | | | |
|---|---|---|---|
| 3,047,089 | A | 7/1962 | Zwislocki |
| D208,784 | S | 10/1967 | Sanzone |
| 3,586,794 | A | 6/1971 | Michaelis |
| 3,696,377 | A | 10/1972 | Wall |
| 3,934,100 | A | 1/1976 | Harada |
| 3,983,336 | A | 9/1976 | Malek et al. |
| 4,069,400 | A | 1/1978 | Johanson et al. |
| 4,150,262 | A | 4/1979 | Ono |
| 4,334,315 | A | 6/1982 | Ono et al. |
| D266,271 | S | 9/1982 | Johanson et al. |
| 4,375,016 | A | 2/1983 | Harada |
| 4,588,867 | A | 5/1986 | Konomi |
| 4,617,429 | A | 10/1986 | Bellafiore |
| 4,654,883 | A | 3/1987 | Iwata |
| 4,682,180 | A | 7/1987 | Gans |
| 4,791,673 | A | 12/1988 | Schreiber |
| 4,852,177 | A | 7/1989 | Ambrose |
| 4,865,044 | A | 9/1989 | Wallace et al. |
| 4,984,277 | A | 1/1991 | Bisgaard et al. |
| 5,008,943 | A | 4/1991 | Arndt et al. |
| 5,185,802 | A | 2/1993 | Stanton |
| 5,191,602 | A | 3/1993 | Regen et al. |
| 5,201,007 | A | 4/1993 | Ward et al. |
| 5,201,008 | A | 4/1993 | Arndt et al. |
| D340,286 | S | 10/1993 | Seo |
| 5,280,524 | A | 1/1994 | Norris |
| 5,295,193 | A | 3/1994 | Ono |
| 5,298,692 | A | 3/1994 | Ikeda et al. |
| 5,343,532 | A | 8/1994 | Shugart |
| 5,347,584 | A | 9/1994 | Narisawa |
| 5,363,444 | A | 11/1994 | Norris |
| 5,444,786 | A | 8/1995 | Raviv |
| D367,113 | S | 2/1996 | Weeks |
| 5,497,339 | A | 3/1996 | Bernard |
| 5,606,621 | A | 2/1997 | Reiter et al. |
| 5,613,222 | A | 3/1997 | Guenther |
| 5,654,530 | A | 8/1997 | Sauer et al. |
| 5,692,059 | A | 11/1997 | Kruger |
| 5,721,783 | A | 2/1998 | Anderson |
| 5,748,743 | A | 5/1998 | Weeks |
| 5,749,072 | A | 5/1998 | Mazurkiewicz et al. |
| 5,771,438 | A | 6/1998 | Palermo et al. |
| D397,796 | S | 9/1998 | Yabe et al. |
| 5,802,167 | A | 9/1998 | Hong |
| 5,844,996 | A | 12/1998 | Enzmann et al. |
| D410,008 | S | 5/1999 | Almqvist |
| 5,929,774 | A | 7/1999 | Charlton |
| 5,933,506 | A | 8/1999 | Aoki et al. |
| 5,949,896 | A | 9/1999 | Nageno et al. |
| 5,987,146 | A | 11/1999 | Pluvinage et al. |
| 6,021,207 | A | 2/2000 | Puthuff et al. |
| 6,054,989 | A | 4/2000 | Robertson et al. |
| 6,081,724 | A | 6/2000 | Wilson |
| 6,084,526 | A | 7/2000 | Blotky et al. |
| 6,094,492 | A | 7/2000 | Boesen |
| 6,111,569 | A | 8/2000 | Brusky et al. |
| 6,112,103 | A | 8/2000 | Puthuff |
| 6,157,727 | A | 12/2000 | Rueda |
| 6,167,039 | A | 12/2000 | Karlsson et al. |
| 6,181,801 | B1 | 1/2001 | Puthuff et al. |
| 6,185,152 | B1 | 2/2001 | Shen |
| 6,208,372 | B1 | 3/2001 | Barraclough |
| 6,230,029 | B1 | 5/2001 | Yegiazaryan et al. |
| 6,275,789 | B1 | 8/2001 | Moser et al. |
| 6,339,754 | B1 | 1/2002 | Flanagan et al. |
| D455,835 | S | 4/2002 | Anderson et al. |
| 6,408,081 | B1 | 6/2002 | Boesen |
| 6,424,820 | B1 | 7/2002 | Burdick et al. |
| D464,039 | S | 10/2002 | Boesen |
| 6,470,893 | B1 | 10/2002 | Boesen |
| D468,299 | S | 1/2003 | Boesen |
| D468,300 | S | 1/2003 | Boesen |
| 6,542,721 | B2 | 4/2003 | Boesen |
| 6,560,468 | B1 | 5/2003 | Boesen |
| 6,563,301 | B2 | 5/2003 | Gventer |
| 6,654,721 | B2 | 11/2003 | Handelman |
| 6,664,713 | B2 | 12/2003 | Boesen |
| 6,690,807 | B1 | 2/2004 | Meyer |
| 6,694,180 | B1 | 2/2004 | Boesen |
| 6,718,043 | B1 | 4/2004 | Boesen |
| 6,738,485 | B1 | 5/2004 | Boesen |
| 6,748,095 | B1 | 6/2004 | Goss |
| 6,754,358 | B1 | 6/2004 | Boesen et al. |
| 6,784,873 | B1 | 8/2004 | Boesen et al. |
| 6,823,195 | B1 | 11/2004 | Boesen |
| 6,852,084 | B1 | 2/2005 | Boesen |
| 6,879,698 | B2 | 4/2005 | Boesen |
| 6,892,082 | B2 | 5/2005 | Boesen |
| 6,920,229 | B2 | 7/2005 | Boesen |
| 6,952,483 | B2 | 10/2005 | Boesen et al. |
| 6,987,986 | B2 | 1/2006 | Boesen |
| 7,010,137 | B1 | 3/2006 | Leedom et al. |
| 7,113,611 | B2 | 9/2006 | Leedom et al. |
| D532,520 | S | 11/2006 | Kampmeier et al. |
| 7,136,282 | B1 | 11/2006 | Rebeske |
| 7,203,331 | B2 | 4/2007 | Boesen |
| 7,209,569 | B2 | 4/2007 | Boesen |
| 7,215,790 | B2 | 5/2007 | Boesen et al. |
| D549,222 | S | 8/2007 | Huang |
| D554,756 | S | 11/2007 | Sjursen et al. |
| 7,403,629 | B1 | 7/2008 | Aceti et al. |
| D579,006 | S | 10/2008 | Kim et al. |
| 7,463,902 | B2 | 12/2008 | Boesen |
| 7,508,411 | B2 | 3/2009 | Boesen |
| 7,532,901 | B1 | 5/2009 | LaFranchise et al. |
| D601,134 | S | 9/2009 | Elabidi et al. |
| 7,825,626 | B2 | 11/2010 | Kozisek |
| 7,859,469 | B1 | 12/2010 | Rosener et al. |
| 7,965,855 | B1 | 6/2011 | Ham |
| 7,979,035 | B2 | 7/2011 | Griffin et al. |
| 7,983,628 | B2 | 7/2011 | Boesen |
| D647,491 | S | 10/2011 | Chen et al. |
| 8,095,188 | B2 | 1/2012 | Shi |
| 8,108,143 | B1 | 1/2012 | Tester |
| 8,140,357 | B1 | 3/2012 | Boesen |
| D666,581 | S | 9/2012 | Perez |
| 8,300,864 | B2 | 10/2012 | Müllenborn et al. |
| 8,406,448 | B2 | 3/2013 | Lin |
| 8,430,817 | B1 | 4/2013 | Al-Ali et al. |
| 8,436,780 | B2 | 5/2013 | Schantz et al. |
| D687,021 | S | 7/2013 | Yuen |
| 8,679,012 | B1 | 3/2014 | Kayyali |
| 8,719,877 | B2 | 5/2014 | VonDoenhoff et al. |
| 8,774,434 | B2 | 7/2014 | Zhao et al. |
| 8,831,266 | B1 | 9/2014 | Huang |
| 8,891,800 | B1 | 11/2014 | Shaffer |
| 8,994,498 | B2 | 3/2015 | Agrafioti et al. |
| D728,107 | S | 4/2015 | Martin et al. |
| 9,013,145 | B2 | 4/2015 | Castillo et al. |
| 9,037,125 | B1 | 5/2015 | Kadous |
| D733,103 | S | 6/2015 | Jeong et al. |
| 9,081,944 | B2 | 7/2015 | Camacho et al. |
| 9,461,403 | B2 | 10/2016 | Gao et al. |
| 9,510,159 | B1 | 11/2016 | Cuddihy et al. |
| D773,439 | S | 12/2016 | Walker |
| D775,158 | S | 12/2016 | Dong et al. |
| D777,710 | S | 1/2017 | Palmborg et al. |
| 9,544,689 | B2 | 1/2017 | Fisher et al. |
| D788,079 | S | 5/2017 | Son et al. |
| 9,684,778 | B2 | 6/2017 | Tharappel et al. |
| 9,711,062 | B2 | 7/2017 | Ellis et al. |
| 9,729,979 | B2 | 8/2017 | Özden |
| 9,767,709 | B2 | 9/2017 | Ellis |
| 9,848,257 | B2 | 12/2017 | Ambrose et al. |
| 9,949,008 | B2 * | 4/2018 | Hviid ..... H04R 1/1016 |
| 2001/0005197 | A1 | 6/2001 | Mishra et al. |
| 2001/0027121 | A1 | 10/2001 | Boesen |
| 2001/0043707 | A1 | 11/2001 | Leedom |
| 2001/0056350 | A1 | 12/2001 | Calderone et al. |

(56) References Cited

U.S. PATENT DOCUMENTS

2002/0002413 A1 1/2002 Tokue
2002/0007510 A1 1/2002 Mann
2002/0010590 A1 1/2002 Lee
2002/0030637 A1 3/2002 Mann
2002/0046035 A1 4/2002 Kitahara et al.
2002/0057810 A1 5/2002 Boesen
2002/0076073 A1 6/2002 Taenzer et al.
2002/0118852 A1 8/2002 Boesen
2003/0002705 A1 1/2003 Boesen
2003/0065504 A1 4/2003 Kraemer et al.
2003/0100331 A1 5/2003 Dress et al.
2003/0104806 A1 6/2003 Ruef et al.
2003/0115068 A1 6/2003 Boesen
2003/0125096 A1 7/2003 Boesen
2003/0218064 A1 11/2003 Conner et al.
2004/0070564 A1 4/2004 Dawson et al.
2004/0102931 A1 5/2004 Ellis et al.
2004/0160511 A1 8/2004 Boesen
2005/0017842 A1 1/2005 Dematteo
2005/0043056 A1 2/2005 Boesen
2005/0094839 A1 5/2005 Gwee
2005/0125320 A1 6/2005 Boesen
2005/0148883 A1 7/2005 Boesen
2005/0165663 A1 7/2005 Razumov
2005/0196009 A1 9/2005 Boesen
2005/0197063 A1 9/2005 White
2005/0212911 A1 9/2005 Marvit et al.
2005/0251455 A1 11/2005 Boesen
2005/0266876 A1 12/2005 Boesen
2006/0029246 A1 2/2006 Boesen
2006/0073787 A1 4/2006 Lair et al.
2006/0074671 A1 4/2006 Farmaner et al.
2006/0074808 A1 4/2006 Boesen
2006/0166715 A1 7/2006 Engelen et al.
2006/0166716 A1 7/2006 Seshadri et al.
2006/0220915 A1 10/2006 Bauer
2006/0258412 A1 11/2006 Liu
2007/0102009 A1 5/2007 Wong et al.
2007/0239225 A1 10/2007 Saringer
2007/0269785 A1 11/2007 Yamanoi
2008/0076972 A1 3/2008 Dorogusker et al.
2008/0090622 A1 4/2008 Kim et al.
2008/0102424 A1 5/2008 Holljes
2008/0146890 A1 6/2008 LeBoeuf et al.
2008/0187163 A1 8/2008 Goldstein et al.
2008/0215239 A1 9/2008 Lee
2008/0253583 A1 10/2008 Goldstein et al.
2008/0254780 A1 10/2008 Kuhl et al.
2008/0255430 A1 10/2008 Alexandersson et al.
2008/0298606 A1 12/2008 Johnson et al.
2009/0003620 A1 1/2009 McKillop et al.
2009/0008275 A1 1/2009 Ferrari et al.
2009/0017881 A1 1/2009 Madrigal
2009/0041313 A1 2/2009 Brown
2009/0073070 A1 3/2009 Rofougaran
2009/0097689 A1 4/2009 Prest et al.
2009/0105548 A1 4/2009 Bart
2009/0154739 A1 6/2009 Zellner
2009/0191920 A1 7/2009 Regen et al.
2009/0226017 A1 9/2009 Abolfathi et al.
2009/0240947 A1 9/2009 Goyal et al.
2009/0245559 A1 10/2009 Boltyenkov et al.
2009/0261114 A1 10/2009 McGuire et al.
2009/0296968 A1 12/2009 Wu et al.
2009/0303073 A1 12/2009 Gilling et al.
2009/0304210 A1 12/2009 Weisman
2010/0033313 A1 2/2010 Keady et al.
2010/0075631 A1 3/2010 Black et al.
2010/0166206 A1 7/2010 Macours
2010/0203831 A1 8/2010 Muth
2010/0210212 A1 8/2010 Sato
2010/0290636 A1 11/2010 Mao et al.
2010/0320961 A1 12/2010 Castillo et al.
2011/0018731 A1 1/2011 Linsky et al.
2011/0103609 A1 5/2011 Pelland et al.
2011/0137141 A1 6/2011 Razoumov et al.
2011/0140844 A1 6/2011 McGuire et al.
2011/0239497 A1 10/2011 McGuire et al.
2011/0286615 A1 11/2011 Olodort et al.
2011/0293105 A1 12/2011 Arie et al.
2012/0057740 A1 3/2012 Rosal
2012/0155670 A1 6/2012 Rutschman
2012/0159617 A1 6/2012 Wu et al.
2012/0163626 A1 6/2012 Booij et al.
2012/0197737 A1 8/2012 LeBoeuf et al.
2012/0235883 A1 9/2012 Border et al.
2012/0309453 A1 12/2012 Maguire
2013/0106454 A1 5/2013 Liu et al.
2013/0154826 A1 6/2013 Ratajczyk
2013/0178967 A1 7/2013 Mentz
2013/0200999 A1 8/2013 Spodak et al.
2013/0204617 A1 8/2013 Kuo et al.
2013/0293494 A1 11/2013 Reshef
2013/0316642 A1 11/2013 Newham
2013/0346168 A1 12/2013 Zhou et al.
2014/0004912 A1 1/2014 Rajakarunanayake
2014/0014697 A1 1/2014 Schmierer et al.
2014/0020089 A1 1/2014 Perini, II
2014/0072136 A1 3/2014 Tenenbaum et al.
2014/0072146 A1 3/2014 Itkin et al.
2014/0073429 A1 3/2014 Meneses et al.
2014/0079257 A1 3/2014 Ruwe et al.
2014/0106677 A1 4/2014 Altman
2014/0122116 A1 5/2014 Smythe
2014/0146973 A1 5/2014 Liu et al.
2014/0153768 A1 6/2014 Hagen et al.
2014/0163771 A1 6/2014 Demeniuk
2014/0185828 A1 7/2014 Helbling
2014/0219467 A1 8/2014 Kurtz
2014/0222462 A1 8/2014 Shakil et al.
2014/0235169 A1 8/2014 Parkinson et al.
2014/0247957 A1* 9/2014 Hagedorn-Olsen ..... H04R 25/654 381/328
2014/0270227 A1 9/2014 Swanson
2014/0270271 A1 9/2014 Dehe et al.
2014/0276227 A1 9/2014 Pérez
2014/0310595 A1 10/2014 Acharya et al.
2014/0321682 A1 10/2014 Kofod-Hansen et al.
2014/0335908 A1 11/2014 Krisch et al.
2014/0348367 A1 11/2014 Vavrus et al.
2015/0028996 A1 1/2015 Agrafioti et al.
2015/0035643 A1 2/2015 Kursun
2015/0036835 A1 2/2015 Chen
2015/0056584 A1 2/2015 Boulware et al.
2015/0110587 A1 4/2015 Hori
2015/0148989 A1 5/2015 Cooper et al.
2015/0181356 A1 6/2015 Krystek et al.
2015/0230022 A1 8/2015 Sakai et al.
2015/0245127 A1 8/2015 Shaffer
2015/0256949 A1 9/2015 Vanpoucke et al.
2015/0264472 A1 9/2015 Aase
2015/0264501 A1 9/2015 Hu et al.
2015/0317565 A1 11/2015 Li et al.
2015/0358751 A1 12/2015 Deng et al.
2015/0359436 A1 12/2015 Shim et al.
2015/0364058 A1 12/2015 Lagree et al.
2015/0373467 A1 12/2015 Gelter
2015/0373474 A1 12/2015 Kraft et al.
2015/0379251 A1 12/2015 Komaki
2016/0033280 A1 2/2016 Moore et al.
2016/0034249 A1 2/2016 Lee et al.
2016/0071526 A1 3/2016 Wingate et al.
2016/0072558 A1 3/2016 Hirsch et al.
2016/0073189 A1 3/2016 Lindén et al.
2016/0094550 A1 3/2016 Bradley et al.
2016/0100262 A1 4/2016 Inagaki
2016/0119737 A1 4/2016 Mehnert et al.
2016/0124707 A1 5/2016 Ermilov et al.
2016/0125892 A1 5/2016 Bowen et al.
2016/0140870 A1 5/2016 Connor
2016/0142818 A1 5/2016 Park
2016/0162259 A1 6/2016 Zhao et al.
2016/0209691 A1 7/2016 Yang et al.

(56) References Cited

U.S. PATENT DOCUMENTS

| | | | |
|---|---|---|---|
| 2016/0253994 | A1 | 9/2016 | Panchapagesan et al. |
| 2016/0324478 | A1 | 11/2016 | Goldstein |
| 2016/0353196 | A1 | 12/2016 | Baker et al. |
| 2016/0360350 | A1 | 12/2016 | Watson et al. |
| 2017/0021257 | A1 | 1/2017 | Gilbert et al. |
| 2017/0046503 | A1 | 2/2017 | Cho et al. |
| 2017/0059152 | A1 | 3/2017 | Hirsch et al. |
| 2017/0060262 | A1 | 3/2017 | Hviid et al. |
| 2017/0060269 | A1 | 3/2017 | Förstner et al. |
| 2017/0061751 | A1 | 3/2017 | Loermann et al. |
| 2017/0061817 | A1 | 3/2017 | Mettler May |
| 2017/0062913 | A1 | 3/2017 | Hirsch et al. |
| 2017/0064426 | A1 | 3/2017 | Hviid |
| 2017/0064428 | A1 | 3/2017 | Hirsch |
| 2017/0064432 | A1 | 3/2017 | Hviid et al. |
| 2017/0064437 | A1 | 3/2017 | Hviid et al. |
| 2017/0078780 | A1 | 3/2017 | Qian et al. |
| 2017/0078785 | A1 | 3/2017 | Qian et al. |
| 2017/0100277 | A1 | 4/2017 | Ke |
| 2017/0108918 | A1 | 4/2017 | Boesen |
| 2017/0109131 | A1 | 4/2017 | Boesen |
| 2017/0110124 | A1 | 4/2017 | Boesen et al. |
| 2017/0110899 | A1 | 4/2017 | Boesen |
| 2017/0111723 | A1 | 4/2017 | Boesen |
| 2017/0111725 | A1 | 4/2017 | Boesen et al. |
| 2017/0111726 | A1 | 4/2017 | Martin et al. |
| 2017/0111740 | A1 | 4/2017 | Hviid et al. |
| 2017/0127168 | A1 | 5/2017 | Briggs et al. |
| 2017/0131094 | A1 | 5/2017 | Kulik |
| 2017/0142511 | A1 | 5/2017 | Dennis |
| 2017/0146801 | A1 | 5/2017 | Stempora |
| 2017/0150920 | A1 | 6/2017 | Chang et al. |
| 2017/0151085 | A1 | 6/2017 | Chang et al. |
| 2017/0151447 | A1 | 6/2017 | Boesen |
| 2017/0151668 | A1 | 6/2017 | Boesen |
| 2017/0151918 | A1 | 6/2017 | Boesen |
| 2017/0151930 | A1 | 6/2017 | Boesen |
| 2017/0151957 | A1 | 6/2017 | Boesen |
| 2017/0151959 | A1 | 6/2017 | Boesen |
| 2017/0153114 | A1 | 6/2017 | Boesen |
| 2017/0153636 | A1 | 6/2017 | Boesen |
| 2017/0154532 | A1 | 6/2017 | Boesen |
| 2017/0155985 | A1 | 6/2017 | Boesen |
| 2017/0155992 | A1 | 6/2017 | Perianu et al. |
| 2017/0155993 | A1 | 6/2017 | Boesen |
| 2017/0155997 | A1 | 6/2017 | Boesen |
| 2017/0155998 | A1 | 6/2017 | Boesen |
| 2017/0156000 | A1 | 6/2017 | Boesen |
| 2017/0164890 | A1 | 6/2017 | Leip et al. |
| 2017/0178631 | A1 | 6/2017 | Boesen |
| 2017/0180842 | A1 | 6/2017 | Boesen |
| 2017/0180843 | A1 | 6/2017 | Perianu et al. |
| 2017/0180897 | A1 | 6/2017 | Perianu |
| 2017/0188127 | A1 | 6/2017 | Perianu et al. |
| 2017/0188132 | A1 | 6/2017 | Hirsch et al. |
| 2017/0193978 | A1 | 7/2017 | Goldman |
| 2017/0195829 | A1 | 7/2017 | Belverato et al. |
| 2017/0208393 | A1 | 7/2017 | Boesen |
| 2017/0214987 | A1 | 7/2017 | Boesen |
| 2017/0215016 | A1 | 7/2017 | Dohmen et al. |
| 2017/0230752 | A1 | 8/2017 | Dohmen et al. |
| 2017/0251933 | A1 | 9/2017 | Braun et al. |
| 2017/0257698 | A1 | 9/2017 | Boesen et al. |
| 2017/0258329 | A1 | 9/2017 | Marsh |
| 2017/0263236 | A1 | 9/2017 | Boesen et al. |
| 2017/0263376 | A1 | 9/2017 | Verschueren et al. |
| 2017/0266494 | A1 | 9/2017 | Crankson et al. |
| 2017/0273622 | A1 | 9/2017 | Boesen |
| 2017/0280257 | A1 | 9/2017 | Gordon et al. |
| 2017/0301337 | A1 | 10/2017 | Golani et al. |
| 2017/0361213 | A1 | 12/2017 | Goslin et al. |
| 2017/0366233 | A1 | 12/2017 | Hviid et al. |
| 2018/0007994 | A1 | 1/2018 | Boesen et al. |
| 2018/0008194 | A1 | 1/2018 | Boesen |
| 2018/0008198 | A1 | 1/2018 | Kingscott |
| 2018/0009447 | A1 | 1/2018 | Boesen et al. |
| 2018/0011006 | A1 | 1/2018 | Kingscott |
| 2018/0011682 | A1 | 1/2018 | Milevski et al. |
| 2018/0011994 | A1 | 1/2018 | Boesen |
| 2018/0012228 | A1 | 1/2018 | Milevski et al. |
| 2018/0013195 | A1 | 1/2018 | Hviid et al. |
| 2018/0014102 | A1 | 1/2018 | Hirsch et al. |
| 2018/0014103 | A1 | 1/2018 | Martin et al. |
| 2018/0014104 | A1 | 1/2018 | Boesen et al. |
| 2018/0014107 | A1 | 1/2018 | Razouane et al. |
| 2018/0014108 | A1 | 1/2018 | Dragicevic et al. |
| 2018/0014109 | A1 | 1/2018 | Boesen |
| 2018/0014113 | A1 | 1/2018 | Boesen |
| 2018/0014140 | A1 | 1/2018 | Milevski et al. |
| 2018/0014436 | A1 | 1/2018 | Milevski |
| 2018/0034951 | A1 | 2/2018 | Boesen |
| 2018/0040093 | A1 | 2/2018 | Boesen |
| 2018/0042501 | A1 | 2/2018 | Adi et al. |

FOREIGN PATENT DOCUMENTS

| | | | |
|---|---|---|---|
| CN | 104837094 | A | 8/2015 |
| EP | 1469659 | A1 | 10/2004 |
| EP | 1017252 | A3 | 5/2006 |
| EP | 2903186 | A1 | 8/2015 |
| GB | 2074817 | | 4/1981 |
| GB | 2508226 | A | 5/2014 |
| JP | 06292195 | | 10/1998 |
| WO | 2008103925 | A1 | 8/2008 |
| WO | 2008113053 | A1 | 9/2008 |
| WO | 2007034371 | A3 | 11/2008 |
| WO | 2011001433 | A2 | 1/2011 |
| WO | 2012071127 | A1 | 5/2012 |
| WO | 2013134956 | A1 | 9/2013 |
| WO | 2014046602 | A1 | 3/2014 |
| WO | 2014043179 | A3 | 7/2014 |
| WO | 2015061633 | A2 | 4/2015 |
| WO | 2015110577 | A1 | 7/2015 |
| WO | 2015110587 | A1 | 7/2015 |
| WO | 2016032990 | A1 | 3/2016 |
| WO | 2016187869 | A1 | 12/2016 |

OTHER PUBLICATIONS

Stretchgoal—Windows Phone Support (Feb. 17, 2014).

The Dash + The Charging Case & The BRAGI News (Feb. 21, 2014).

The Dash—A Word From Our Software, Mechanical and Acoustics Team + An Update (Mar. 11, 2014).

Update From BRAGI—$3,000,000—Yipee (Mar. 22, 2014).

Weisiger; "Conjugated Hyperbilirubinemia", Jan. 5, 2016.

Wertzner et al., "Analysis of fundamental frequency, jitter, shimmer and vocal intensity in children with phonological disorders", V. 71, n.5, 582-588, Sep./Oct. 2005; Brazilian Journal of Othrhinolaryngology.

Wikipedia, "Gamebook", https://en.wikipedia.org/wiki/Gamebook, Sep. 3, 2017, 5 pages.

Wikipedia, "Kinect", "https://en.wikipedia.org/wiki/Kinect", 18 pages, (Sep. 9, 2017).

Wikipedia, "Wii Balance Board", "https://en.wikipedia.org/wiki/Wii_Balance_Board", 3 pages, (Jul. 20, 2017).

Akkermans, "Acoustic Ear Recognition for Person Identification", Automatic Identification Advanced Technologies, 2005 pp. 219-223.

Alzahrani et al: "A Multi-Channel Opto-Electronic Sensor to Accurately Monitor Heart Rate against Motion Artefact during Exercise", Sensors, vol. 15, No. 10, Oct. 12, 2015, pp. 25681-25702, XPO55334602, DOI: 10.3390/s151025681 the whole document.

Announcing the $3,333,333 Stretch Goal (Feb. 24, 2014).

Ben Coxworth: "Graphene-based ink could enable low-cost, foldable electronics", "Journal of Physical Chemistry Letters", Northwestern University, (May 22, 2013).

Blain: "World's first graphene speaker already superior to Sennheiser MX400", htt://www.gizmag.com/graphene-speaker-beats-sennheiser-mx400/31660, (Apr. 15, 2014).

(56) References Cited

OTHER PUBLICATIONS

BMW, "BMW introduces BMW Connected—The personalized digital assistant", "http://bmwblog.com/2016/01/05/bmw-introduces-bmw-connected-the-personalized-digital-assistant", (Jan. 5, 2016).
BRAGI Is on Facebook (2014).
BRAGI Update—Arrival of Prototype Chassis Parts—More People—Awesomeness (May 13, 2014).
BRAGI Update—Chinese New Year, Design Verification, Charging Case, More People, Timeline(Mar. 6, 2015).
BRAGI Update—First Sleeves From Prototype Tool—Software Development Kit (Jun. 5, 2014).
BRAGI Update—Let's Get Ready to Rumble, A Lot to Be Done Over Christmas (Dec. 22, 2014).
BRAGI Update—Memories From April—Update on Progress (Sep. 16, 2014).
BRAGI Update—Memories from May—Update on Progress—Sweet (Oct. 13, 2014).
BRAGI Update—Memories From One Month Before Kickstarter—Update on Progress (Jul. 10, 2014).
BRAGI Update—Memories From the First Month of Kickstarter—Update on Progress (Aug. 1, 2014).
BRAGI Update—Memories From the Second Month of Kickstarter—Update on Progress (Aug. 22, 2014).
BRAGI Update—New People @BRAGI—Prototypes (Jun. 26, 2014).
BRAGI Update—Office Tour, Tour to China, Tour to CES (Dec. 11, 2014).
BRAGI Update—Status on Wireless, Bits and Pieces, Testing—Oh Yeah, Timeline(Apr. 24, 2015).
BRAGI Update—The App Preview, The Charger, The SDK, BRAGI Funding and Chinese New Year (Feb. 11, 2015).
BRAGI Update—What We Did Over Christmas, Las Vegas & CES (Jan. 19, 2014).
BRAGI Update—Years of Development, Moments of Utter Joy and Finishing What We Started(Jun. 5, 2015).
BRAGI Update—Alpha 5 and Back to China, Backer Day, On Track(May 16, 2015).
BRAGI Update—Beta2 Production and Factory Line(Aug. 20, 2015).
BRAGI Update—Certifications, Production, Ramping Up.
BRAGI Update—Developer Units Shipping and Status(Oct. 5, 2015).
BRAGI Update—Developer Units Started Shipping and Status (Oct. 19, 2015).
BRAGI Update—Developer Units, Investment, Story and Status(Nov. 2, 2015).
BRAGI Update—Getting Close(Aug. 6, 2015).
BRAGI Update—On Track, Design Verification, How It Works and What's Next(Jul. 15, 2015).
BRAGI Update—On Track, On Track and Gems Overview.
BRAGI Update—Status on Wireless, Supply, Timeline and Open House@BRAGI(Apr. 1, 2015).
BRAGI Update—Unpacking Video, Reviews on Audio Perform and Boy Are We Getting Close(Sep. 10, 2015).
Healthcare Risk Management Review, "Nuance updates computer-assisted physician documentation solution" (Oct. 20, 2016).
Hoffman, "How to Use Android Beam to Wirelessly Transfer Content Between Devices", (Feb. 22, 2013).
Hoyt et. al., "Lessons Learned from Implementation of Voice Recognition for Documentation in the Military Electronic Health Record System", The American Health Information Management Association (2017).
Hyundai Motor America, "Hyundai Motor Company Introduces A Health + Mobility Concept for Wellness in Mobility", Fountain Valley, Californa (2017).
International Search Report & Written Opinion, PCT/EP16/70245 (dated Nov. 16, 2016).
International Search Report & Written Opinion, PCT/EP2016/070231 (dated Nov. 18, 2016).
International Search Report & Written Opinion, PCT/EP2016/070247 (dated Nov. 18, 2016).
International Search Report & Written Opinion, PCT/EP2016/07216 (dated Oct. 18, 2016).
International Search Report and Written Opinion, PCT/EP2016/070228 (dated Jan. 9, 2017).
Jain A et al: "Score normalization in multimodal biometric systems", Pattern Recognition, Elsevier, GB, vol. 38, No. 12, Dec. 31, 2005, pp. 2270-2285, XPO27610849, ISSN: 0031-3203.
Last Push Before the Kickstarter Campaign Ends on Monday 4pm CET (Mar. 28, 2014).
Lovejoy: "Touch ID built into iPhone display one step closer as third-party company announces new tech","http://9to5mac.com/2015/07/21/virtualhomebutton/" (Jul. 21, 2015).
Nemanja Paunovic et al, "A methodology for testing complex professional electronic systems", Serbian Journal of Electrical Engineering, vol. 9, No. 1, Feb. 1, 2012, pp. 71-80, XPO55317584, YU.
Nigel Whitfield: "Fake tape detectors, 'from the stands' footie and UGH? Internet of Things in my set-top box"; http://www.theregister.co.uk/2014/09/24/ibc_round_up_object_audio_dlna_iot/ (Sep. 24, 2014).
Nuance, "ING Netherlands Launches Voice Biometrics Payment System in the Mobile Banking App Powered by Nuance", "https://www.nuance.com/about-us/newsroom/press-releases/ing-netherlands-launches-nuance-voice-biometirics.html", 4 pages (Jul. 28, 2015).
Staab, Wayne J., et al., "A One-Size Disposable Hearing Aid is Introduced", The Hearing Journal 53(4):36-41) Apr. 2000.
Stretchgoal—It's Your Dash (Feb. 14, 2014).

* cited by examiner

REPRODUCTION OF AMBIENT ENVIRONMENTAL SOUND FOR ACOUSTIC TRANSPARENCY OF EAR CANAL DEVICE SYSTEM AND METHOD

PRIORITY STATEMENT

This application claims priority to U.S. Provisional Patent Application No. 62/211,732, filed Aug. 29, 2015, and is a continuation application of U.S. patent application Ser. No. 15/244,958, filed Aug. 23, 2016 both applications are hereby incorporated by reference in their entirety.

FIELD OF THE INVENTION

The present invention relates to wearable devices. More particularly, but not exclusively, the present invention relates to ear canal devices.

BACKGROUND OF THE ART

The use of ear canal devices is becoming increasingly prevalent. Ear canal devices are gaining recognition for their ability to provide a stable platform for the transmission of sound to the individual from many types of linked devices including, without limitation, phones, portable music players, watches and computers among others. Further, the ear canal has been recognized as a rich area for the monitoring of many biometric parameters. Pulse oximetry, temperature, heart rate, speed and pace are several examples of data that can be tracked or monitored from ear canal devices.

Additionally, they have the advantage of relatively stable positioning on the user, and are subject to less movement variation than sensor arrays that would be worn elsewhere, such as on the wrist. However, the use of these devices can become problematic for the user, as they can cause a decrease in auditory acuity due to their position at the ear canal. Thus, there is a need to restore auditory transparency when using ear canal devices.

SUMMARY

Therefore, it is a primary object, feature, or advantage to improve over the state of the art. It is a further object, feature, or advantage to restore audio transparency when using ear canal devices.

A still further object, feature, or advantage of the present invention is to provide for the ability to use external microphone or microphones to detect ambient environmental sound.

Another object, feature, or advantage of the present invention is to account for the sound shaping characteristics of the external auditory canal.

Yet another object, feature, or advantage of the present invention is to present the signal through the microphone located in the external auditory canal nearest the tympanic membrane to allow the user to perceive acoustic stimuli in such a fashion that the device is acoustically transparent Another object, feature, or advantage is to avoid the need to accept diminished auditory inputs at the level of the external auditory canal.

One or more of these and/or other objects, features, or advantages of the present invention will become apparent from the specification and claims that follow. No single embodiment need exhibit each and every object, feature, or advantage. It is contemplated that different embodiments may have different objects, features, or advantages.

According to one aspect, an ear piece for use by an individual having an external auditory canal is provided. The earpiece includes an earpiece housing configured for placement within the external auditory canal of the individual, a processor disposed within the ear piece housing, at least one microphone disposed within the earpiece housing wherein the at least one earpiece is positioned to detect ambient environmental sound, and at least one speaker disposed within the earpiece housing. The ear piece is configured to detect ambient environmental sound proximate the external auditory canal of the individual using the at least one microphone and reproduce the ambient environmental sound at the at least one speaker within the earpiece housing. The processor may be further configured to modify the ambient environmental sound based on shape of the external auditory canal such that audio perception of the ambient environmental sound is as if the ear piece was not present. The ear piece housing may be water resistant. The at least one speaker may be positioned at the external auditory canal proximate a tympanic membrane of the individual. The ear piece may further include at least one biological sensor operatively connected to the processor. The at least one biological sensor may include a pulse oximeter and/or temperature sensor.

According to another aspect, a method for an ear canal device is provided. The method includes providing an ear piece for use by an individual having an external auditory canal, the ear piece comprising an earpiece housing configured for placement within the external auditory canal of the individual, a processor disposed within the ear piece housing, at least one microphone disposed within the earpiece housing wherein the at least one earpiece is positioned to detect ambient environmental sound, and at least one speaker disposed within the earpiece housing. The method may further include detecting ambient environmental sound proximate the external auditory canal of the individual using the at least one microphone and reproducing at the ambient environmental sound at the at least one speaker within the earpiece housing to thereby provide for audio transparency. The method may further include modifying the ambient environmental sound based on shape of the external audio canal of the individual. The reproducing may occur at the speaker nearest a tympanic membrane of the individual. The ear piece may further include a biological sensor and the method may further provide for sensing a biological parameter using the biological sensor. The biological sensor may be a pulse oximeter, temperature sensor, or other type of biological sensor.

DETAILED DESCRIPTION

To restore auditory transparency when using ear canal devices through the use of at least one external facing microphone to detect incoming auditory stimuli. Said incoming auditory signal can be shaped to account for the characteristics of each user's external auditory canal. Sound would then be presented to the tympanic membrane via a speaker present in the user's external auditory canal. This renders the ear canal device acoustically transparent. The user's hearing is unaffected, and auditory perception is as if the device wasn't physically present at the ear canal.

Figure 1:
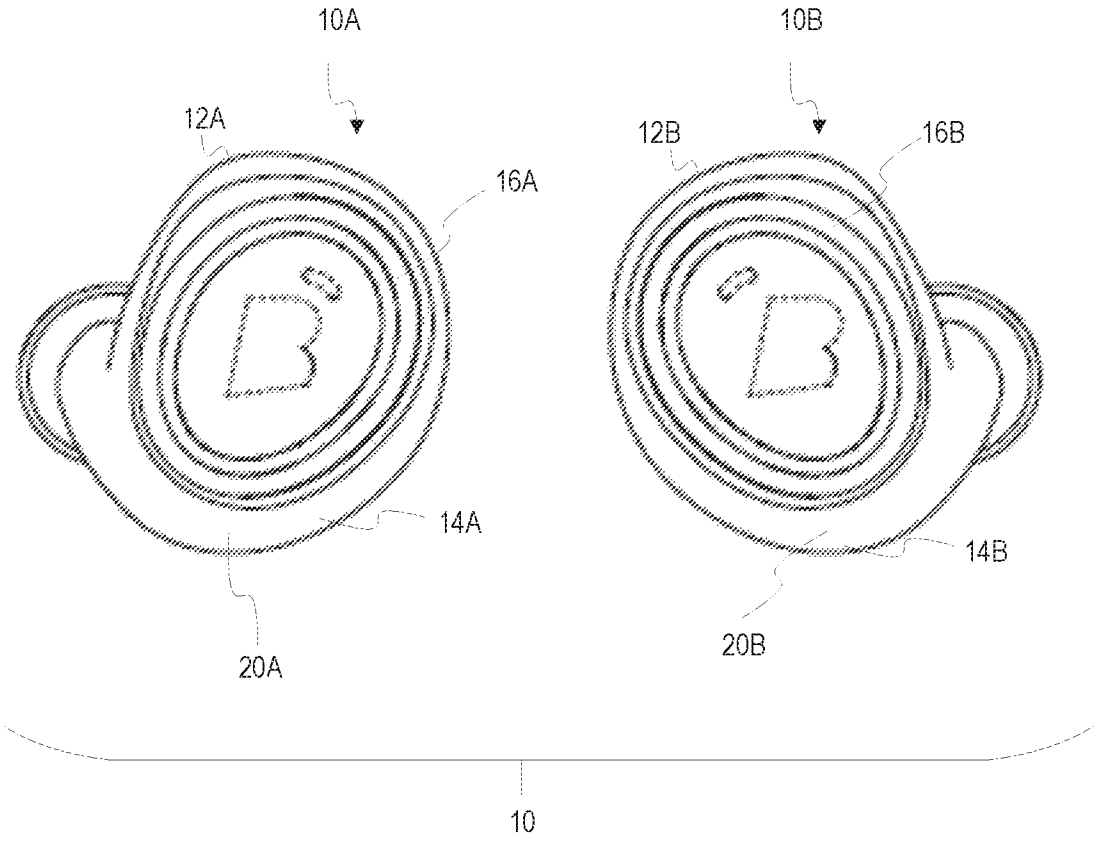
FIG. 1 illustrates one example of a wearable device in the form of a set of earpieces.

FIG. 1 illustrates one example of a wearable device in the form of a set of earpieces 10 including a left ear piece 12A and a right earpiece 12B. Each of the ear pieces 12A, 12B has a housing 14A, 14B which may be in the form of a protective shell or casing and may be an in-the-ear earpiece housing. Note that when each of the earpieces 12A, 12B is placed within a corresponding external auditory canal the external auditory canal of the user would be physically blocked and not open. Thus, the user would not conventionally be able to hear ambient noise. Although perhaps appropriate for use in a hearing aid, this blocking of ambient environmental sound is problematic.

Figure 2:
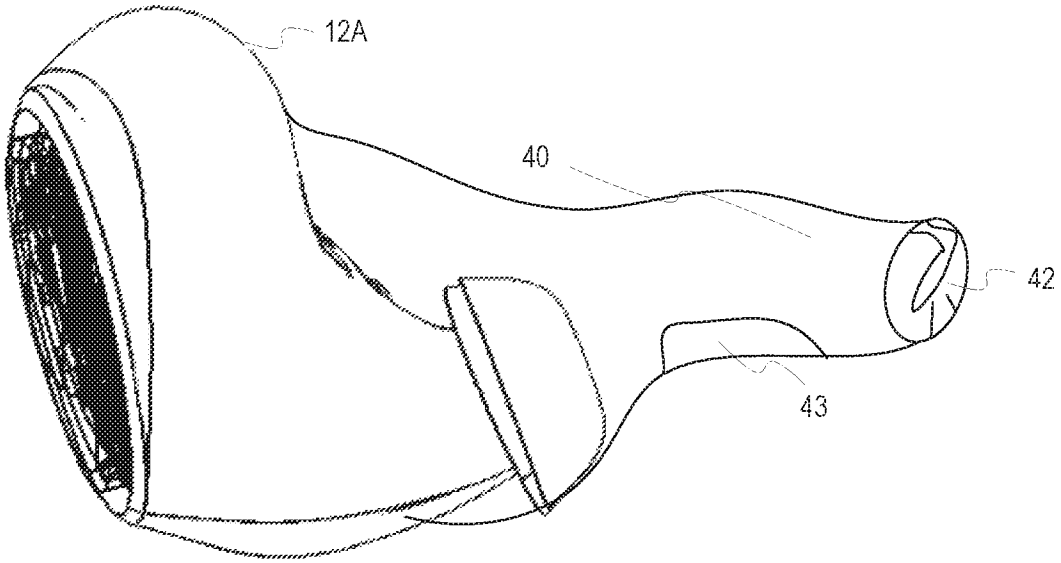
FIG. 2 illustrates one example of an ear piece positioned within an external auditory canal of an individual.

FIG. 2 illustrates an ear piece 12A inserted into an ear of an individual or user. The ear piece 12A fits at least partially into the external auditory canal 40 of the individual. A tympanic membrane 42 is shown at the end of the external auditory canal 40. The earpiece 12A has a sleeve 13A on the earpiece. The sleeve may be formed of silicone or other material which is safe for an individual to wear and which improves comfort for the user. The sleeve may be in any number of sizes including, extra small, small, medium, and large.

Figure 3:
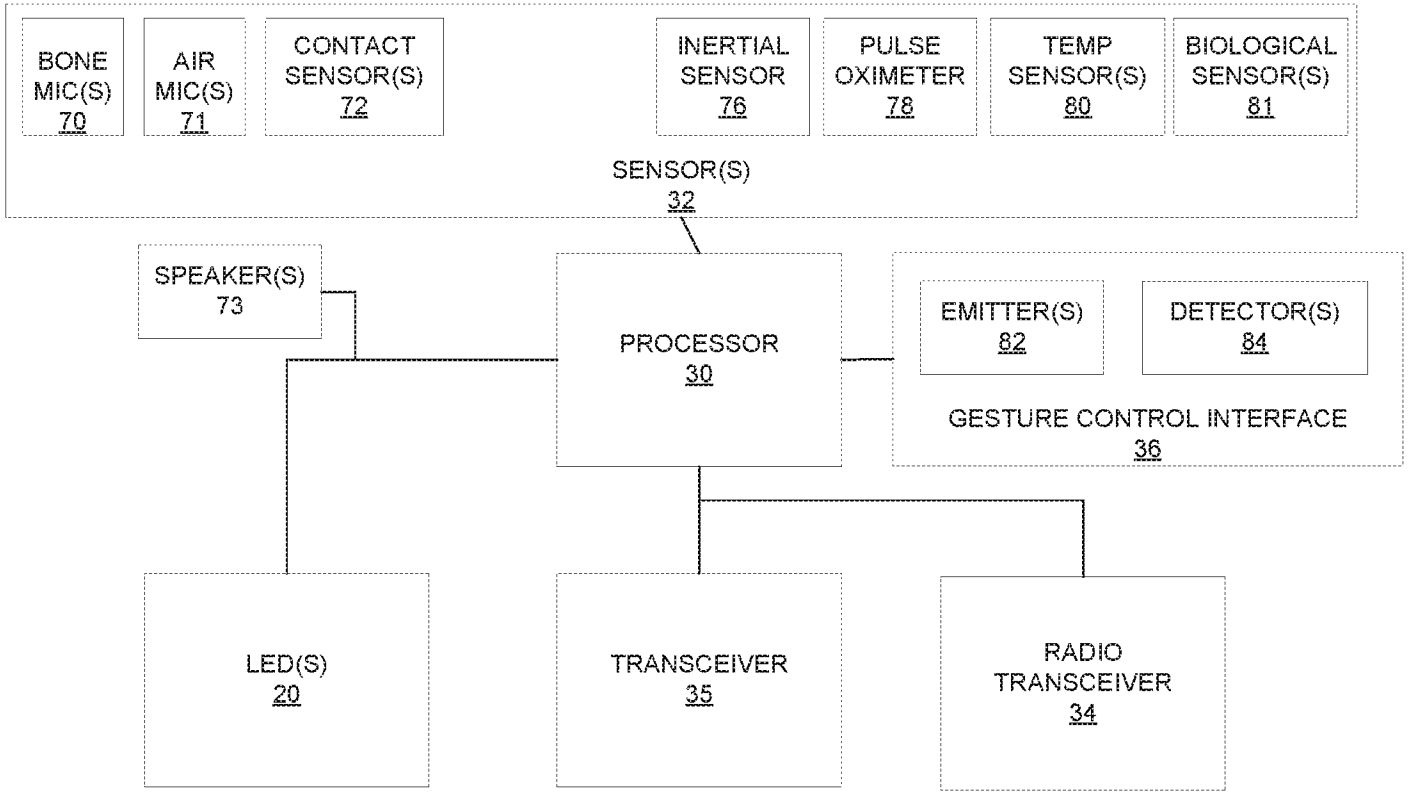
FIG. 3 is a block diagram illustrating one example of a device.

FIG. 3 is a block diagram illustrating a device. The device may include one or more LEDs 20 electrically connected to a processor 30. The processor 30 may also be electrically connected to one or more sensors 32. Where the device is an earpiece, the sensor(s) may include an inertial sensor 76, an accelerometer 74, one or more contact sensors 72, a bone conduction microphone or air conduction microphone 70, a pulse oximeter 76, a temperature sensor 80, or other biological sensors. A gesture control interface 36 is also operatively connected to the process 30. The gesture control interface 36 may include one or more emitters 82 and one or more detectors 84 for sensing user gestures. The emitters may be of any number of types including infrared LEDs. The device may include a transceiver 35 which may allow for induction transmissions such as through near field magnetic induction. A short range transceiver 34 using Bluetooth, UWB, or other means of radio communication may also be present. In operation, the processor 30 may be programmed to convey different information using one or more of the LED(s) 20 based on context or mode of operation of the device. The various sensors 32, the processor 30, and other electronic components may be located on the printed circuit board of the device.

Figure 4:
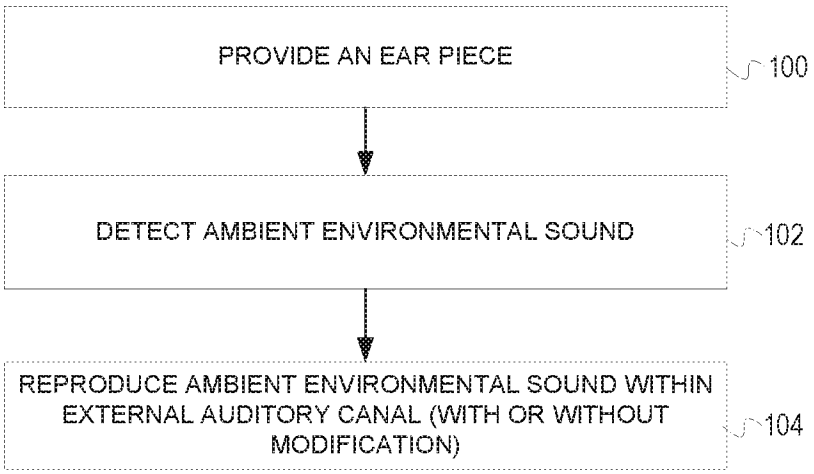
FIG. 4 illustrates one example of a method.

FIG. 4 illustrates one example of a method. As shown in FIG. 4, in step 100 an ear piece is produced. In step 102, the ambient environmental sound is detected. In step 104, the ambient environmental sound is reproduced within the external auditory canal with or without modification. Where the ambient environmental sound is reproduced with modification, the modification may take into account the size and shape of the external auditory canal of the individual in order to modify any received signal in a manner to best approximate or reproduce the sound as if heard directly by the user as opposed to having the sound sensed on one side of the ear piece (the external side) and reproduced at the other side of the ear piece (the inner side nearest the tympanic membrane). The sound processing performed by the ear piece may further take into consideration position of one or more microphones of the external earpiece as well.

Generally, the ear canal is about 2.5 cm (1 in) long and 0.7 cm (0.28 in) in diameter with a sigmoid form and runs from behind and above downward and forward. It has a generally oval cross-section. The size and shape of an external auditory canal of a user may be determined in any number of different ways. For example, sound signals may be emitted by a speaker and reflections of those sound signals may be detected by one or more microphones in order to map the size and shape of the external auditory canal such as by using shifts in frequency or delays. The size and shape of the external auditory canal may also be determined at least in part based on the size of the best fitting earpiece or an associated sleeve which fits around the earpiece. The size and shape of the external auditory canal may be also be determined based on direct measurement, photogrammetry, or other observation. In addition, the user may select different sizes and shapes for their external auditory canal. For example, the earpiece may cycle through a plurality of different size settings and modify a sound differently at each setting. The user may then select through voice command or through the user interface whether the setting or settings produce a better or worse reproduction of the sound in order to select the appropriate settings. The ambient environmental sounds themselves may be modified in various ways based on the different external auditory canal sizes and shapes. For example, one or more sound filters may be associated with each setting or combination of settings. Alternatively, settings regarding ear canal size and shape may be used to parameterize other sound processing algorithms used in reproduction of the environmental sound.

Therefore, various examples of systems, devices, apparatus, and methods for restoring auditory transparency when using ear canal devices through the use of at least one external facing microphone to detect incoming auditory stimuli have been shown and described. Although various embodiments and examples have been set forth, the present invention contemplates numerous variations, options, and alternatives.

What is claimed is:

1. An earpiece for use by an individual having an external auditory canal, comprising:

an earpiece housing configured for placement within the external auditory canal of the individual;

a processor disposed within the earpiece housing;

at least one transceiver operatively connected to the processor;

at least one microphone disposed within the earpiece housing and operatively connected to the processor wherein the at least microphone is positioned to detect ambient environmental sound;

at least one speaker disposed within the earpiece housing and operatively connected to the processor; wherein the speaker is configured to reproduce the ambient environmental sound;

wherein the processor is further configured to determine the size and shape of the external auditory canal; and wherein the processor is further configured to modify the ambient environmental sound based on the size and shape of the external auditory canal.

2. The earpiece of claim 1 wherein the shape of the external auditory canal is determined at least in part based on a size of a sleeve for the earpiece.

3. The earpiece of claim 1 wherein the shape of the external auditory canal is determined by a user setting.

4. The ear piece of claim 1 wherein the earpiece housing is water resistant.

5. The ear piece of claim 1 wherein the at least one speaker is positioned at the external auditory canal proximate a tympanic membrane of the individual.

6. The ear piece of claim 1 wherein the at least one speaker and at least one microphone are used to map the size and shape of the external auditory canal.

7. The ear piece of claim 1 wherein the earpiece further comprises a gestural interface.

8. The ear piece of claim 1 wherein the processor is configured to apply sound filters associated with size and shape of the external auditory canal.

9. The ear piece of claim 1 wherein the at least one microphone comprises a plurality of microphones.

10. A method for an ear canal device, the method comprising:

providing an ear piece for use by an individual having an external auditory canal, the ear piece comprising an earpiece housing configured for placement within the external auditory canal of the individual, a processor disposed within the ear piece housing, a user interface operatively connected to the processor, at least one microphone disposed within the earpiece housing wherein the at least one earpiece is positioned to detect ambient environmental sound, and at least one speaker disposed within the earpiece housing;

detecting ambient environmental sound proximate the external auditory canal of the individual using the at least one microphone;

determining the size or shape of the external auditory canal;

modifying the ambient environmental sound based on shape of the external audio canal of the individual; and reproducing at the ambient environmental sound at the at least one speaker within the earpiece housing to thereby provide for audio transparency.

11. The method of claim 10 wherein the reproducing occurs at one of the at least one speaker nearest a tympanic membrane of the individual.

12. The method of claim 10 wherein the ear piece further comprises a biological sensor and further comprising sensing a biological parameter using the biological sensor.

13. The method of claim 10 wherein the user interface comprises a gestural interface.

14. The method of claim 10 wherein the at least one speaker and at least one microphone are used to map the size and shape of the external auditory canal.

15. The method of claim 10 wherein the earpiece further comprises at least one LED.

16. The method of claim 10 wherein the process is configured to convey information to the user using the at least one LED.

17. The method of claim 10 wherein the shape of the external auditory canal is determined by a user setting.

18. The method of claim 10 wherein the processor cycles through different size settings and modifies the sound differently at each size setting.

19. The method of claim 10 wherein the user selects the size setting by using a user interface.

20. The method of claim 10 wherein the processor is configured to apply sound filters associated with size and shape of the external auditory canal.

* * * * *